US005794101A

United States Patent [19]

Watanabe et al.

[11] Patent Number: 5,794,101

[45] Date of Patent: Aug. 11, 1998

[54] PROCESS CARTRIDGE WITH SEAL MEMBERS

[75] Inventors: Kazushi Watanabe, Yokohama; Yoshikazu Sasago; Toshiyuki Karakama, both of Tokyo, all of Japan

[73] Assignee: Canon Kabushiki Kaisha, Tokyo, Japan

[21] Appl. No.: 569,927

[22] Filed: Dec. 8, 1995

[30] Foreign Application Priority Data

Dec. 21, 1994 [JP] Japan ..... 6-318365

[51] Int. Cl.[6] ..... G03G 15/08

[52] U.S. Cl. ..... 399/103; 399/106

[58] Field of Search ..... 355/200, 210, 355/215, 245, 260; 399/102, 103, 105, 106, 104

[56] References Cited

U.S. PATENT DOCUMENTS

| | | | |
|---|---|---|---|
| 4,615,608 | 10/1986 | Mizutani | 355/245 X |
| 5,057,868 | 10/1991 | Sekino | 355/215 |
| 5,134,960 | 8/1992 | Shirai | 118/653 |
| 5,208,634 | 5/1993 | Ikemoto et al. | 355/215 |
| 5,331,372 | 7/1994 | Tsuda et al. | 355/200 |
| 5,389,732 | 2/1995 | Sekino | 118/653 |
| 5,404,198 | 4/1995 | Noda et al. | 355/200 |
| 5,455,665 | 10/1995 | Baba et al. | 355/298 |
| 5,470,635 | 11/1995 | Shirai et al. | 428/131 |
| 5,475,467 | 12/1995 | Watanabe et al. | 355/200 |
| 5,475,470 | 12/1995 | Sasago et al. | 355/210 |
| 5,488,459 | 1/1996 | Tsuda et al. | 355/211 |
| 5,500,714 | 3/1996 | Yashiro et al. | 355/200 |
| 5,502,547 | 3/1996 | Shirai | 355/215 |
| 5,550,617 | 8/1996 | Odagawa et al. | 355/210 |
| 5,585,895 | 12/1996 | Yashiro et al. | |

*Primary Examiner*—Robert Beatty

*Attorney, Agent, or Firm*—Fitzpatrick, Cella, Harper & Scinto

[57] ABSTRACT

A process cartridge removably mountable onto a main body of an electrophotographic image forming apparatus includes an electrophotographic photosensitive member, a developing device for developing a latent image formed on the electrophotographic photosensitive member, a developing frame, including a toner receptacle for accommodating a toner used for development by the developing device, for supporting the developing device, a toner supply opening, provided in the developing frame, for supplying the developing device with the accommodated toner, a toner seal, detachably mounted on a mounting portion provided at the circumference of the toner supply opening of the developing frame, for sealing the toner supply opening, and seal members provided in a state of being overlapped on the toner seal at the mounting portion in order to prevent leakage of the toner from the developing frame. The seal member are preferably mounted on mounting members which can either slide into grooves or are integral with a developing device frame member. The mounting members can be made from a magnetic material.

20 Claims, 10 Drawing Sheets

PROCESS CARTRIDGE WITH SEAL MEMBERS

BACKGROUND OF THE INVENTION

1. Field of the Invention

This invention relates to a process cartridge and to an electrophotographic image forming apparatus for forming an image according to an electrophotographic method.

2. Description of the Related Art

In an electrophotographic image forming apparatus, such as an electrophotographic printer or the like, a latent image is formed by performing a selective exposure on an electrophotographic photosensitive member uniformly charged by a charger, and the latent image is developed by a developing unit using a developing agent (hereinafter termed a "toner") to provide a visualized image. Image recording is performed on a recording medium by transferring the toner image onto the recording medium. In such an apparatus, maintenance of the components of the apparatus is performed by a specially-trained serviceman.

A process cartridge method has been practially used in which, by integrating the electrophotographic photosensitive member, the charger, the developing unit, a cleaning unit and the like within a frame, and mounting and detaching the cartridge in the main body of the apparatus by the user, a component, such as the electrophotographic photosensitive member or the like, which requires replenishment of the toner or which reaches the end of its useful life, can be exchanged, thereby facilitating maintenance of the apparatus.

In order to prevent the toner within a toner receptacle from being supplied to a developing chamber before using the process cartridge, an opening seal member is provided over a toner supply opening for communicating the toner receptable with the developing chamber. In addition, in order to prevent the toner from leaking between a developing roller, mounted in the developing chamber, and a developing frame, end-portion seal members must be provided between the developing roller and the developing frame in the vicinity of end portions of the developing roller in the longitudinal direction thereof.

For that purpose, a long seal member is welded on a welding portion in the vicinity of the circumference of the opening as the opening seal member and is folded at one end of the opening, and the folded seal member protrudes outside the cartridge. The end-portion seal members are mounted on a seal mounting portion.

SUMMARY OF THE INVENTION

It is an object of the present invention to provide a process cartridge and an image forming apparatus which can provide stable image quality.

It is another object of the present invention to provide a process cartridge and an image forming apparatus in which leakage of a toner does not occur.

It is still another object of the present invention to provide a process cartridge and an image forming apparatus in which a toner receptacle for accommodating a toner used for development by a developing unit, and a developing frame for supporting the developing unit are provided.

It is yet another object of the present invention to provide a process cartridge and an image forming apparatus in which a toner seal detachably mounted on a mounting portion provided at the circumference of a toner supply opening of a developing frame in order to open the toner supply opening, and seal members provided in a state of being superposed on the toner seal at the mounting portion in order to prevent leakage of a toner from the developing frame to the outside are provided.

According to one aspect, the present invention, which achieves these objectives, relates to a process cartridge removably mountable onto a main body of an electrophotographic image forming apparatus, including an electrophotographic photosensitive member, a developing device for developing a latent image formed on the electrophotographic photosensitive member, a developing frame, including a toner receptacle for acccommodating a toner used for development by the developing device, for supporting the developing device, a toner supply opening, provided in the developing frame, for supplying the developing device with the accommodated toner, a toner seal detachably mounted on a mounting portion provided at the circumference of the toner supply opening of the developing frame in order to open the toner supply opening, and seal members provided in a state of being suprposed on the toner seal at the mounting portion in order to prevent leakage of the toner from the developing frame to the outside.

According to another aspect, the present invention relates to an electrophotographic image forming apparatus to which a process cartridge can be mounted to form an image on a recording medium, including (a) a mounting unit for detachably mounting the process cartridge including an electrophotographic photosensitive member, a developing device for developing a latent image formed on the electrophotographic photosensitive member, a developing frame, including a toner receptacle for acccommodating a toner used for development by the developing device, for supporting the developing device, a toner supply opening, provided in the developing frame, for supplying the developing device with the accommodated toner, a toner seal, detachably mounted on a mounting portion provided at the circumference of the toner supply opening of the developing frame in order to open the toner supply opening, for sealing the toner supply opening, and seal members provided in a state of being superposed on the toner seal at the mounting portion in order to prevent leakage of the toner from the developing frame to the outside, and (b) a conveying unit for conveying the recording medium.

According to still another aspect, the present invention relates to a process cartridge removably mountable onto a main body of an electrophotographic image forming apparatus, including an electrophotographic photosensitive member, a developing roller for conveying a toner to the electrophotographic photosensitive drum by rotating, in order to develop a latent image formed on the electrophotographic photosensitive drum, a developing frame, including a toner receptacle for acccommodating the toner used for development by the developing roller, for supporting the developing roller, a toner supply opening, provided in the developing frame, for supplying the developing roller with the accommodated toner, a toner seal detachably mounted on a mounting portion provided at the circumference of the toner supply opening of the developing frame in order to open the toner supply opening, for sealing the toner supply opening, and seal members provided in a state of being superposed on the toner seal at the mounting portion in order to prevent leakage of the toner from the developing frame to the outside. The seal members are mounted on corresponding seal mounting members to be mounted on the developing frame. The seal members are provided in a state of being superposed on the toner seal at both end portions of the mounting portion in the longitudinal direction by mounting the seal mounting members on the developing frame. The toner supply opening has a long and narrow shape, and the mounting portion is provided along the entire circumference of the toner supply opening having the long and narrow shape. The process cartridge also includes a charging member for charging the electrophotographic photosensitive drum, and a cleaning blade provided in contact with the electrophotographic photosensitive drum in order to remove toner particles remaining on the electrophotographic photosensitive drum therefrom.

According to still another aspect, the present invention relates to an electrophotographic image forming apparatus to which a process cartridge can be mounted to form an image on a recording medium, including (a) a mounting member for detachably mounting the process cartridge including an electrophotographic photosensitive member, a developing roller for conveying a toner to the electrophotographic photosensitive drum by rotating, in order to develop a latent image formed on the electrophotographic photosensitive drum, a developing frame, including a toner receptacle for acccommodating the toner used for development by the developing roller, for supporting the developing roller, a toner supply opening, provided in the developing frame, for supplying the developing roller with the accommodated toner, a toner seal, detachably mounted on a mounting portion provided at the circumference of the toner supply opening of the developing frame in order to open the toner supply opening, for sealing the toner supply opening, and seal members provided in a state of being superposed on the toner seal at the mounting portion in order to prevent leakage of the toner from the developing frame to the outside, the seal members being mounted on corresponding seal mounting members to be mounted on the developing frame, the seal members being provided in a state of being superposed on the toner seal at both end portions of the mounting portion in the longitudinal direction by mounting the seal mounting members on the developing frame, the toner supply opening having a long and narrow shape, and the mounting portion being provided along the entire circumference of the toner supply opening having the long and narrow shape, a charging member for charging the electrophotographic photosensitive drum, and a cleaning blade provided in contact with the electrophotographic photosensitive drum in order to remove toner particles remaining on the electrophotographic photosensitive drum therefrom, the mounting member including guide portions for guiding the process cartridge, and (b) a conveying member for conveying the recording medium.

The foregoing and other objects, advantages and features of the present invention will become more apparent from the following detailed description of the preferred embodiments taken in conjuction with the accompanying drawings.

DETAILED DESCRIPTION OF THE PREFERRED EMBODIMENTS

With reference to the drawings, a description will now be provided of an electrophotographic image forming apparatus on which a process cartridge according to one of embodiments of the present invention is removably mountable.

Each of the following embodiments relates to a process cartridge removably mountable onto a main body of an electrophotographic image forming apparatus including a developing frame, including a developer accommodating unit for accommodating a developer, for supporting a developer bearing member, an opening seal member for sealing a developer supply opening of the developer accommodating unit, and mounting members for mounting end-portion seal members for sealing the developer between the developer bearing member and the developing frame in the vicinity of the developer bearing member in the longitudinal direction. The mounting members are provided as members separated from the developing frame, and are mounted on the developing frame in a state of being superposed on a mounting portion of the opening seal member. The embodiments also relates to an electrophotographic image forming apparatus on which the above-described process cartridge is removably mountable.

In the above-described configuration, when sealing the toner supply opening with the opening seal member in the longitudinal direction of the toner bearing member, the mounting members can be mounted on the developing frame in a state of being superposed on the mounting portion of the opening seal member because the mounting members are provided as members separated from the developing frame. Accordingly, the end-portion seal member can be mounted in the vicinity of the circumference of the toner supply opening. As a result, it is possible to supply the toner in accordance with the recording width without providing a long toner bearing member, and to prevent dispersion of the toner at end portions of the developing region.

First Embodiment

First, a description will be provided of a process cartridge and an electrophotographic image forming apparatus according to a first embodiment of the present invention with reference to FIGS. 1 through 4.

First, the entire configuration of the process cartridge and the image forming apparatus on which the process cartridge is removably mountable will be described. Then, the configuration of the frame of the developing unit will be described.

Entire configuration

Figure 2:
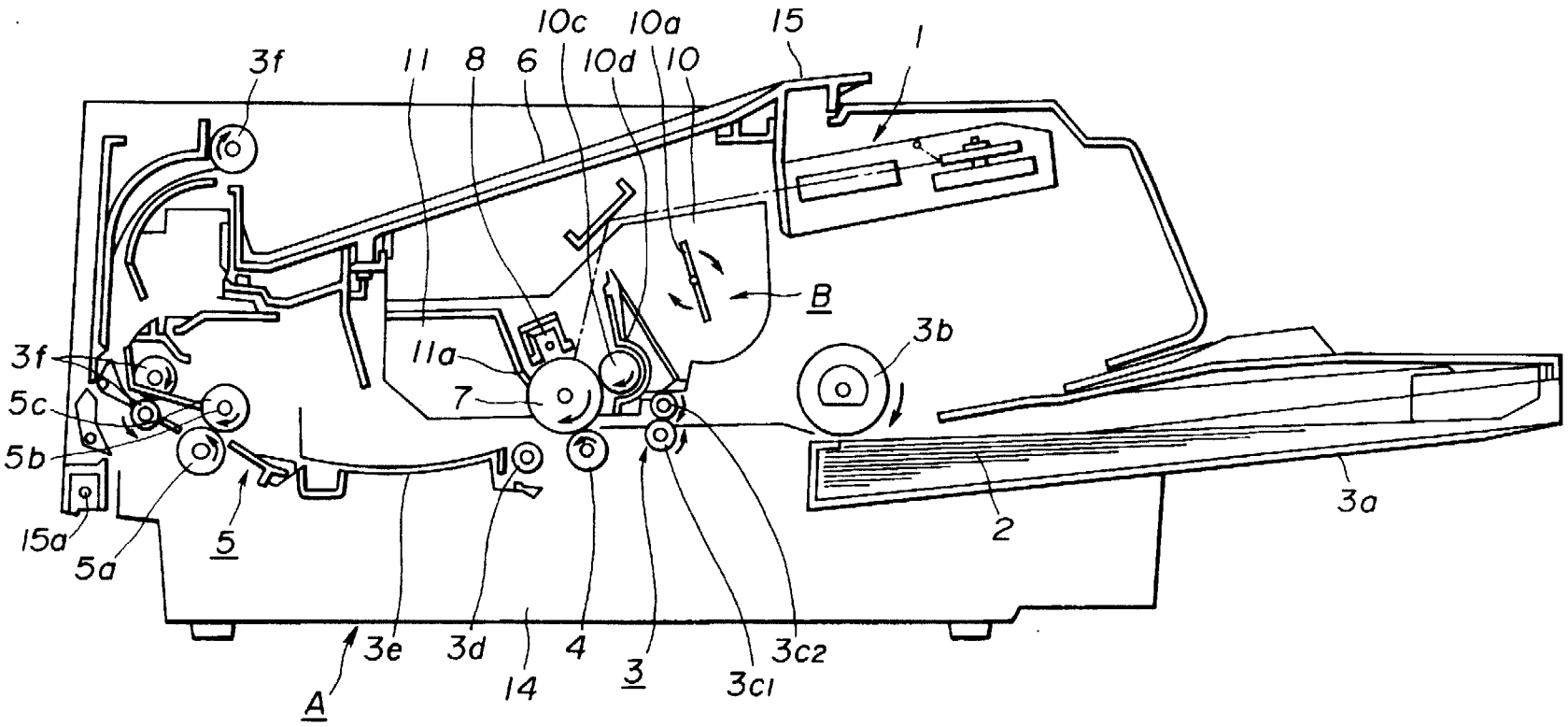
FIG. 2 is cross-sectional view illustrating the configuration of an image forming apparatus for mounting the process cartridge of the first embodiment.

As shown in FIG. 2, in this electrophotographic image forming apparatus A, an optical system 1 projects an optical image corresponding to image information onto a charged drum-shaped electrophotographic photosensitive member, i.e., drum 7, to form a latent image. The latent image is developed using a toner to form a toner image. In synchronization with the formation of the toner image, a recording medium 2 is conveyed from a cassette 3*a* by conveying means 3, which includes a pickup roller 3*b*, a pair of registration rollers $3c_1$ and $3c_2$, and the like. The toner image formed on the electrophotographic photosensitive member is transferred onto the recording medium 2 by applying a voltage to a transfer roller 4, serving as transfer means, and the recording medium 2 is conveyed to fixing means 5 by an intermediate discharging roller 3*d* and a guide plate 3*e*.

The fixing means 5 includes a driving roller 5*a*, and a fixing roller 5*c* incorporating a heater 5*b*, and fixes the transferred toner image on the recording medium 2 by applying heat and pressure to the recording medium 2. The recording medium 2 is then conveyed by a pair of discharging rollers 3*f*, and is discharged onto a discharging unit 6 via a reversal conveying path.

Figure 1:
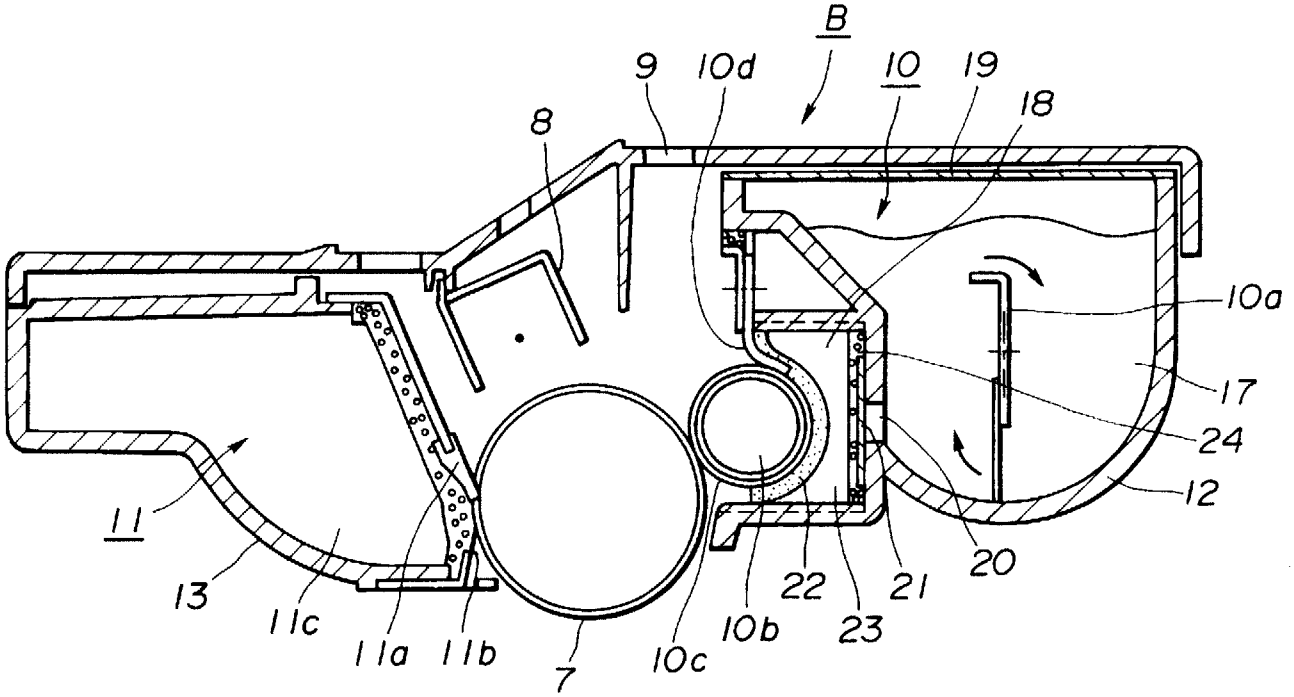
FIG. 1 is a cross-sectional view illustrating the configuration of a process cartridge according to a first embodiment of the present invention.

As shown in FIGS. 1 and 2, in the process cartridge B, a photosensitive drum 7 having a photosensitive layer, serving as the electrophotographic photosensitive member, is rotated, and its surface is uniformly charged by applying a voltage to a charging unit 8. The latent image is formed by projecting an optical image from the optical system 1 onto the photosensitive drum 7 via an exposure unit 9. The latent image is developed by developing means 10.

The developing means 10 supplies a toner within a toner receptable to a developing chamber using a toner supply member 10*a*. A developing roller 10*c*, serving as a toner bearing member, incorporating a fixed magnet 10*b*, is rotated in a state in which the supplied toner adheres to the circumferential surface of the developing roller 10*c*. A toner layer having triboelectric charges is formed on the surface of the developing roller 10*c* while regulating the thickness of the toner layer adhered to the circumferential surface of the developing roller 10*c* by a developing blade 10*d*, serving as a toner-layer regulating member. The latent image is visualized by forming the toner image by transferring the toner onto the photosensitive drum 7 in accordance with the latent image.

Then, the toner image formed on the photosensitive drum 7 is transferred onto the recording medium 2 by applying a voltage having a polarity opposite to the polarity of the toner image to the transfer roller 4. Thereafter, toner particles remaining on the photosensitive drum 7 are scraped off by a cleaning blade 11*a*. The removed toner particles are scooped by a sweeping sheet 11*b*, and are collected in a waste toner reservoir 11*c*. Accordingly, toner particles remaining on the photosensitive drum 7 are removed by the cleaning means 11.

The respective components, such as the photosensitive drum 7 and the like, are accommodated within a cartridge frame obtained by connecting a developing frame 12 and a cleaning frame 13 to provide a cartridge, which is removably mounted on cartridge mounting means provided in a main body 14 of the apparatus.

Figure 3A:
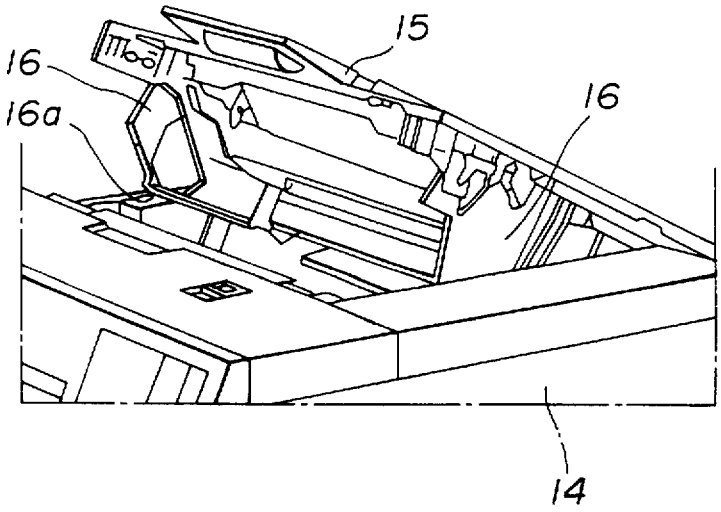
FIGS. 3(*a*) and 3(*b*) are diagrams illustrating the states before and after the process cartridge is mounted in the image forming apparatus, respectively.
Figure 3B:
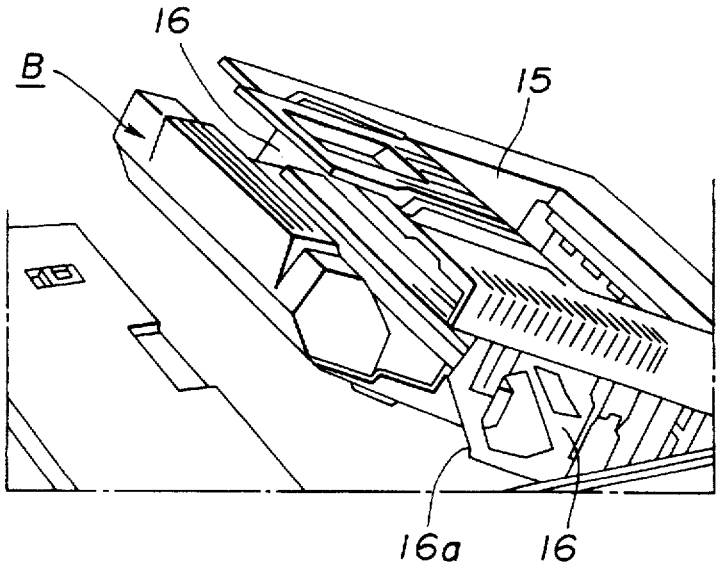

A description will now be provided of the cartridge mounting means. As shown in FIGS. 3(*a*) and 3(*b*), when an opening/closing member 15 is opened around a shaft 15*a* (see FIG. 1), cartridge-mounting guide members 16 are present at left and right inner sides of the opening/closing member 15, and guide portions 16*a* for inserting the process cartridge B are provided at the left and right guide members 16 so as to face each other. By inserting the process cartridge B along the guide portions 16*a* and closing the opening/closing member 15, the cartridge B is mounted in the image forming apparatus A.

The configuration of the frame of the developing means

Next, a description will be provided of the configuration of the frame for supporting the developing means 10. In the present embodiment, as shown in FIG. 1, a toner receptacle 17 and a developing chamber 18 are integrated to provide a developing frame 12. The developing means 10 is configured by mounting the toner supply member 10*a*, the developing roller 10*c* and the developing blade 10*d* in the developing frame 12, and connecting a cover member 19 above the developing frame 12.

A long and narrow toner supply opening 20 is formed between the toner receptacle 17 and the developing chamber 18 in the developing frame 12, and the toner within the toner receptacle 17 is supplied from the toner supply opening 20 to the developing chamber 18.

Before the process cartridge B is used, the toner supply opening 20 is sealed by welding a long opening seal member 21 on a circumferential portion of the toner supply opening 20, so that the toner within the toner receptable 17 is not supplied to the developing chamber 18.

Figure 4:
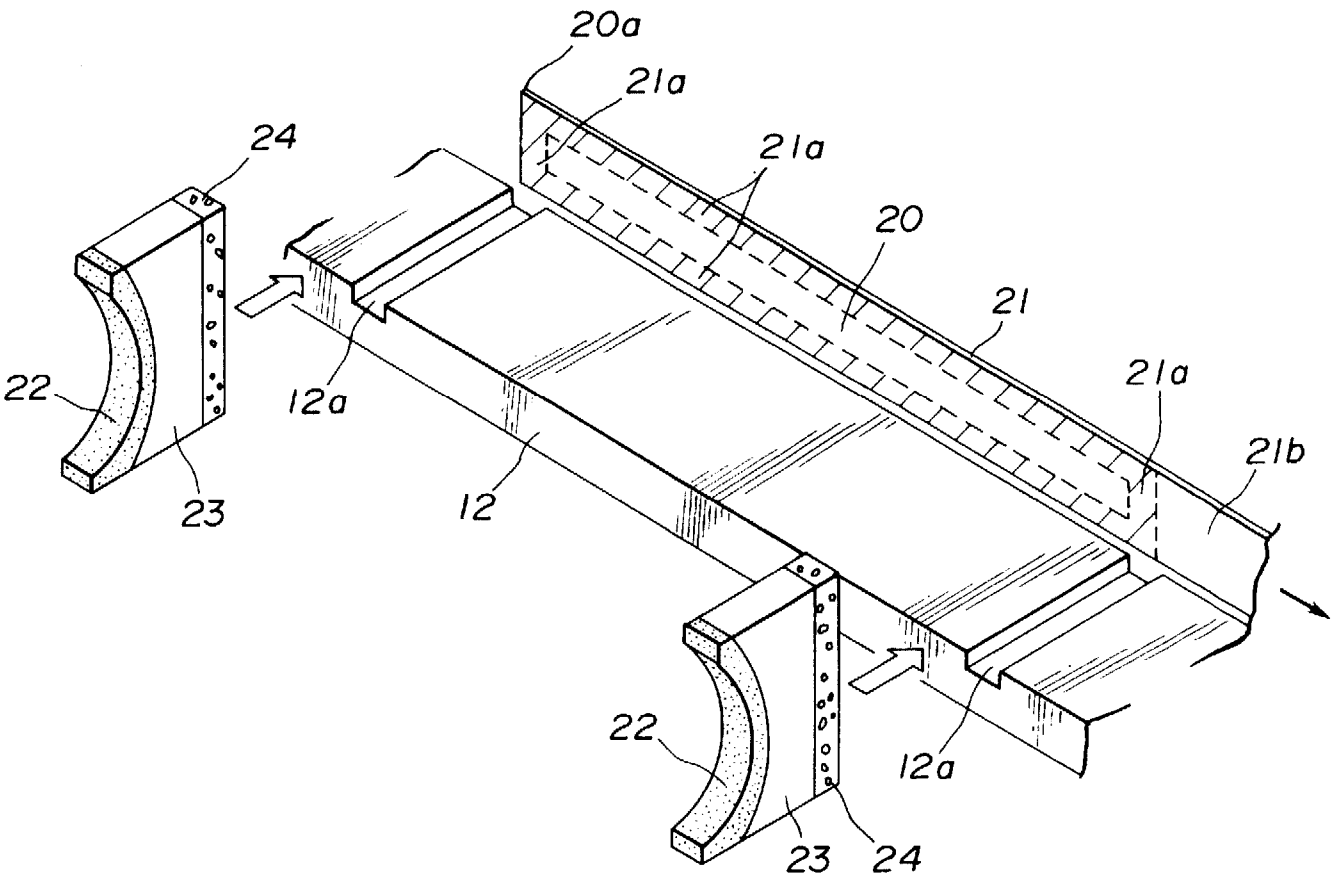
FIG. 4 is a diagram illustrating the configuration of a frame of a developing unit of the first embodiment.

As shown in FIGS. 1 and 4, the opening seal member 21 is folded at one end 20*a* of the toner supply opening 20 in the longitudinal direction, and an end portion 21*b* of the opening seal member 21 is exposed outside the cartridge frame. By an operation of pulling the opening seal member 21 by the user while grasping the exposed end portion 21*b* when starting to use the cartridge, the toner supply opening 20 is opened to supply the developing chamber 18 with the toner within the toner receptable 17.

In order to prevent leakage of the toner from a portion between the developing roller 10*c* and the developing frame 12 to the outside, end-portion seal members 22 are provided in the vicinity of both end portions of the developing roller 10*c* in the longitudinal direction.

A description will now be provided of a configuration for mounting the end-portion seal members 22.

As shown in FIGS. 1 and 4, each of the end-portion seal members 22 is mounted on a circular surface of a seal mounting member 23 facing the developing roller 10*c* so as to be in tight contact with the circumferential surface of the developing roller 10*c* in order to prevent leakage of the toner from a portion between the developing roller 10*c* and the developing frame 12. The seal mounting members 23 are provided as members separate from the developing frame 12, and are fitted in corresponding grooves 12*a* provided in the developing frame 12 and are fixed to the developing frame 12 using screws or the like. A seal 24, made of rubber, sponge, or the like, is mounted on a surface of each of the mounting members 23 facing the toner receptacle 17 in order to prevent leakage of the toner from a portion between the developing frame 12 and the mounting member 23.

The mounting members 23 are mounted on the developing frame 12 so that the mounting members 23 are overlapped with (or superposed on) welding portions 21*a*, consitituting the mounting portion of the opening seal member 21, present at both ends of the opening seal member 21 in the longitudinal direction. That is, the seals 24 are mounted so as to be superposed on (on overlapped with) the opening seal member 21 at the welding portions 21*a*.

According to the above-described configuration, it is possible to open the toner supply opening 20 up to inner end portions of the end-portion seal members 22 in the longitudinal direction of the developing roller 10*c*, and therefore to uniformly supply the toner up to portions in the vicinity of the end-portion seal members 22 of the developing roller 10c. That is, it is possible to shorten the length of the developing frame 12 in the longitudinal direction compared with a case in which the seal members 24 are superposed on the opening seal member 21 at portions other than the welding portions 21a.

Since the mounting members 23 press the opening seal member 21 against the developing frame 12 via the seals 24, toner particles adhered to the opening seal member 21 are scraped off by the seals 24 when drawing the opening seal member 21. Accordingly, for example, the hands of the user are not soiled by the opening seal member 21 which has been drawn.

Second Embodiment

Figure 5:
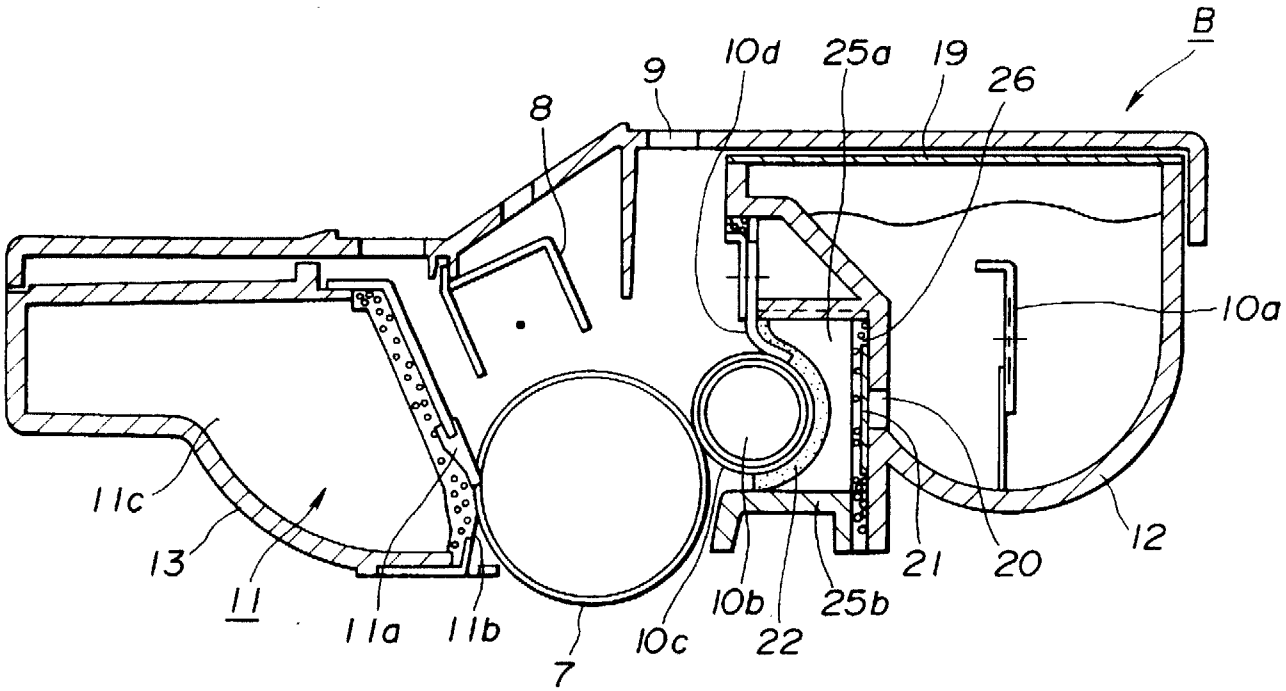
FIG. 5 is a cross-sectional view illustrating the configuration of a process cartridge according to a second embodiment of the present invention.
Figure 6:
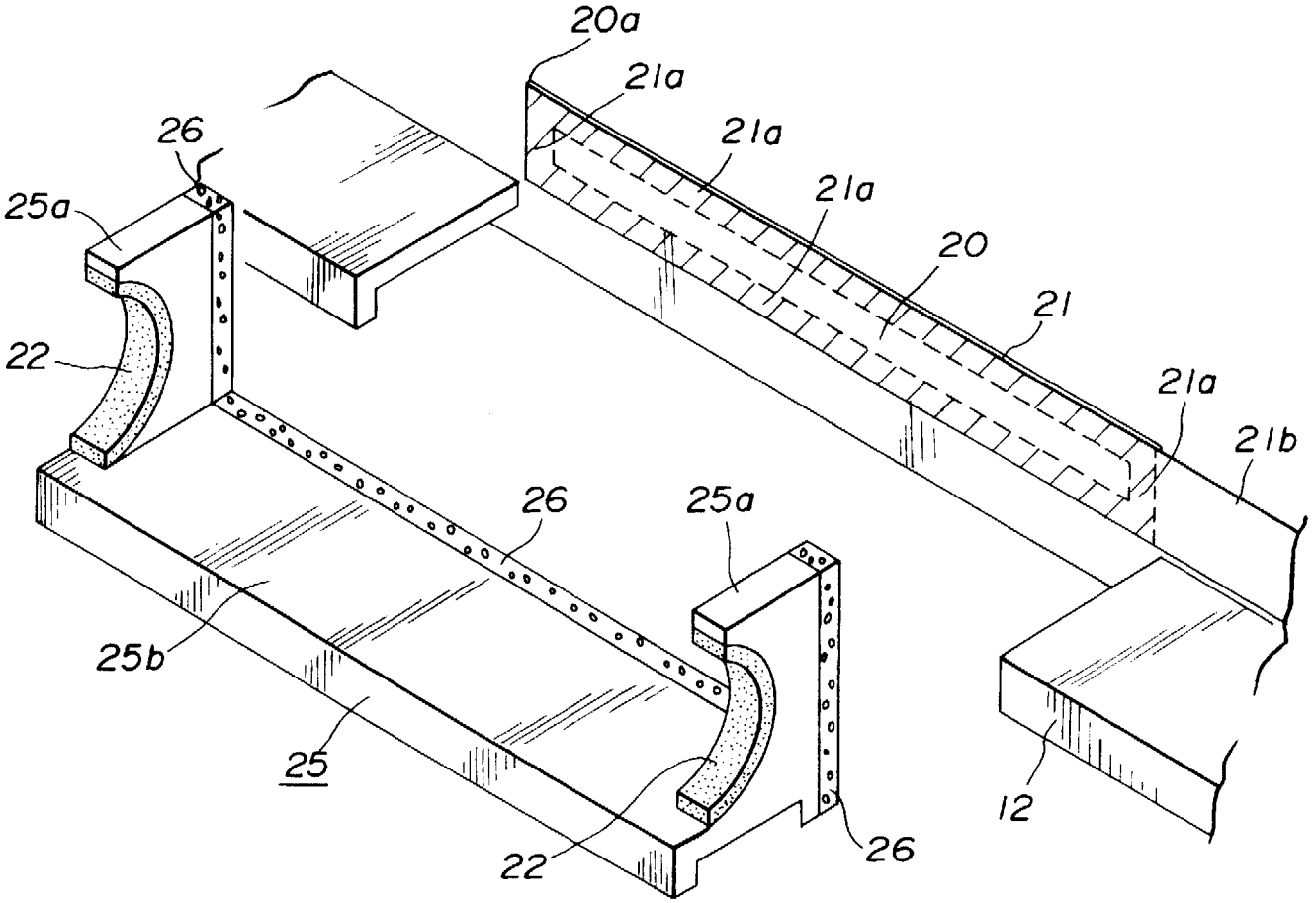
FIG. 6 is a diagram illustrating the configuration of a frame of a developing unit of the second embodiment.

Next, a description will be provided of end-portion-seal mounting members according to a second embodiment of the present invention with reference to FIGS. 5 and 6. The basic configuration of a process cartridge and an image forming apparatus on which the process cartridge is removably mountable according to the second embodiment is the same as in the first embodiment. Hence, a description will be provided of only a configuration different from the configuration of the first embodiment. Those components having the same functions as in the first embodiment are indicated by the same reference characters.

In the first embodiment, the case, in which in order to mount the seals 24, the two mounting members 23 are separately mounted on the developing frame 12, has been illustrated. In the second embodiment, however, as shown in FIG. 6, two mounting portions 25a for mounting end-portion seal members 22 are integrated with a lower wall 25b of the developing chamber 18 to provide a mounting member 25, which is mounted on the developing frame 12. A seal 26, made of rubber, sponge, or the like, for preventing leakage of the toner is provided on a surface of the mounting member 25 facing the toner supply opening 20.

The mounting member 25 is mounted so that the mounting portions 25a are superposed on the welding portions 21a present at both ends of the opening seal member 21 in the longitudinal direction. Hence, the seal 26 is mounted in a state of being superposed on the opening seal member 21 at the welding portions 21a.

According to the second embodiment, as in the first embodiment, it is possible to open the toner supply opening 20 up to substantially the same positions as the end-portion seal members 22, and to uniformly supply the developing roller 10c with the toner between the end-portion seal members 22 present at both ends of the developing roller 10c in the longitudinal direction. It is also possible to shorten the length of the developing frame 12 in the longitudinal direction.

In the second embodiment, when it is necessary to widen the toner supply opening 20 toward the lower side in FIG. 6 depending on developing conditions or the like, it is also possible to overlap the portion of the lower wall 25b of the mounting member 25 with a lower welding portion 21a of the opening seal member 21. As a result, the lower side of the toner supply opening 20 can be widened as much as possible.

Third Embodiment

Figure 7:
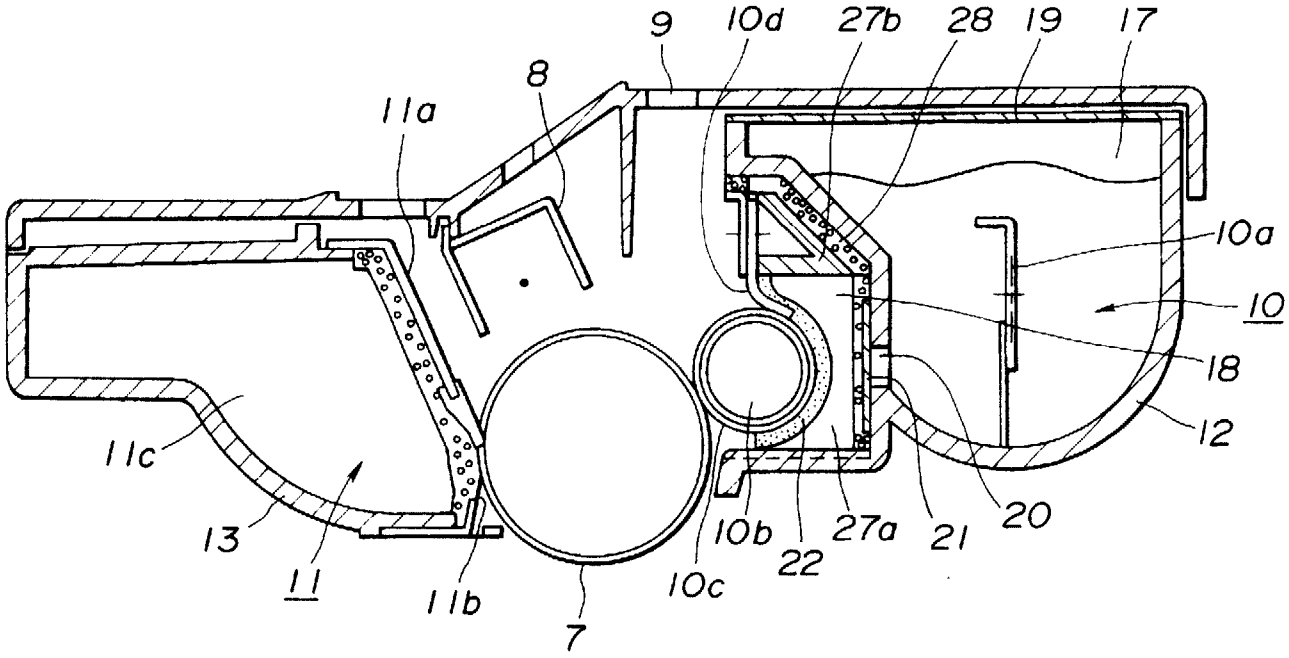
FIG. 7 is a cross-sectional view illustrating the configuration of a process cartridge according to a third embodiment of the present invention.
Figure 8:
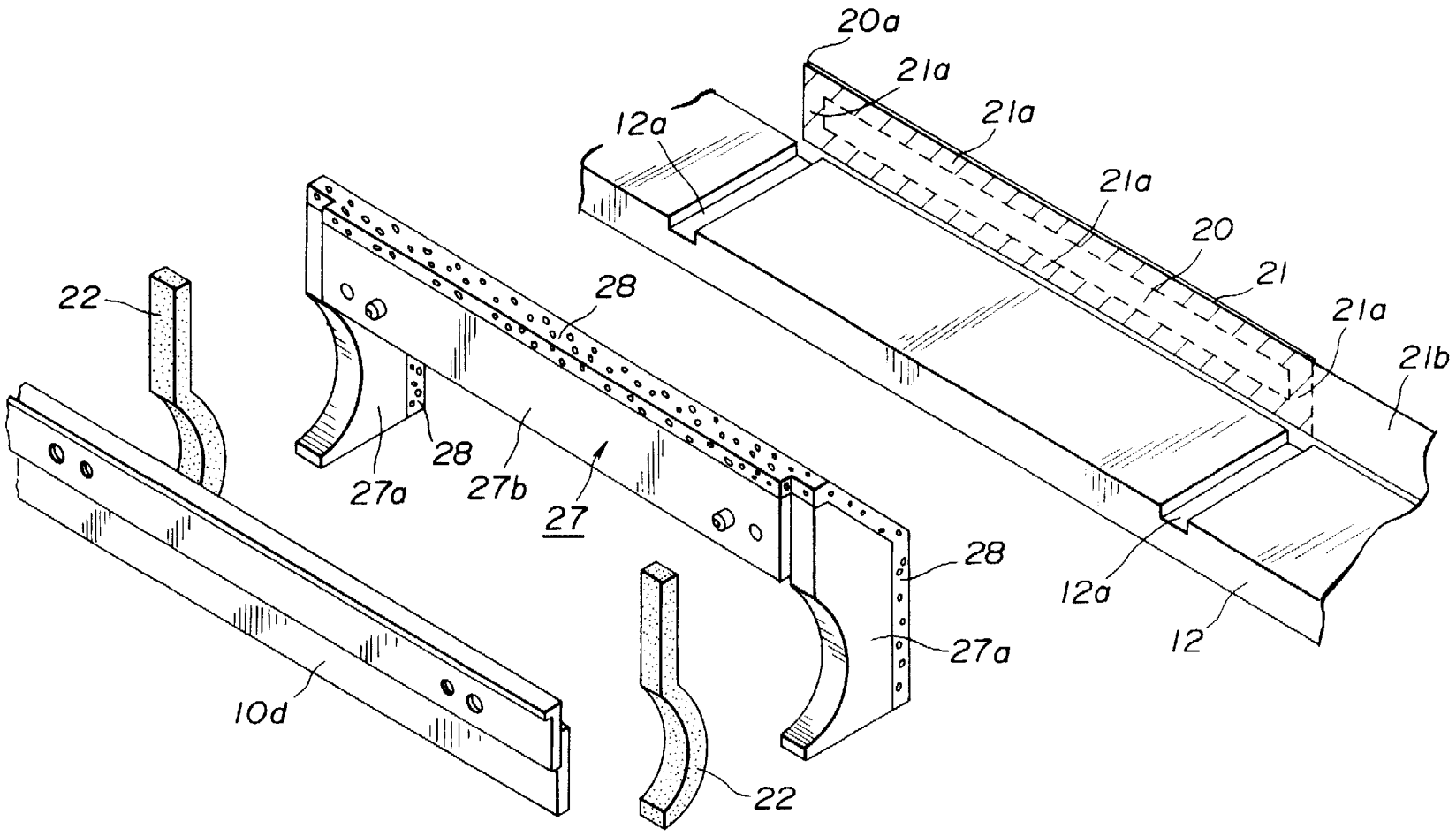
FIG. 8 is a diagram illustrating the configuration of a frame of a developing unit of the third embodiment.

Next, a description will be provided of end-portion seal mounting members according to a third embodiment of the present invention, with reference to FIGS. 7 and 8. The basic configuration of a process cartridge and an image forming apparatus on which the process cartridge is removably mountable according to the third embodiment is the same as in the first embodiment. Hence, a description will be provided of only a configuration different from the configuration of the first embodiment. Those components having the same functions as in the first embodiment are indicated by the same reference characters.

In the second embodiment, the mounting member 25 obtained by integrating the two mounting portions 25a for mounting the end-portion seals 22 with the lower wall 25b has been illustrated. In the third embodiment, however, as shown in FIG. 8, two mounting portions 27a are integrated with a developing-blade mounting plate 27b to provide a mounting member 27, which is mounted on the developing frame 12. A seal 28, made of rubber, sponge, or the like, for preventing leakage of the toner is provided on a surface of the mounting member 27 facing the toner supply opening 20.

The mounting member 27 is mounted so that the mounting portions 27a are superposed on the welding portions 21a present at both ends of the opening seal member 21 in the longitudinal direction thereof. Thereafter, the developing blade 10d is mounted on the blade supporting plate 27b using screws or the like. Hence, the seal 28 is mounted in a state of being superposed on the opening seal member 21 at the welding portions 21a.

According to the third embodiment, as in the first embodiment, it is possible to open the toner supply opening 20 up to substantially the same positions as the end-portion seal members 22, and to uniformly supply the developing roller 10c with the toner between the end-portion seal members 22 present at both ends of the developing roller 10c in the longitudinal direction. It is also possible to shorten the length of the developing frame 12 in the longitudinal direction thereof.

In the third embodiment, when it is necessary to widen the toner supply opening 20 toward the upper side in FIG. 8 depending on developing conditions or the like, it is also possible to overlap the upper end of the blade supporting plate 27b of the mounting member 27 with an upper welding portion 21a of the opening seal member 21. As a result, the upper side of the toner supply opening 20 can be widened as much as possible.

Fourth Embodiment

Figure 9:
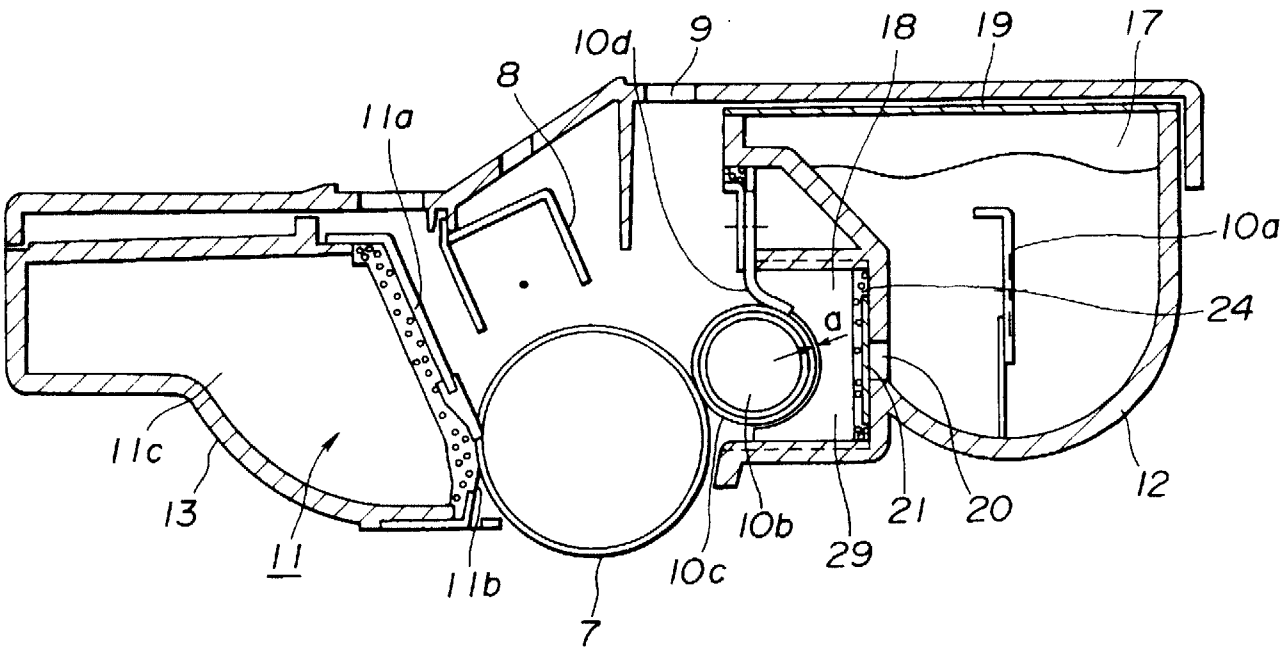
FIG. 9 is a cross-sectional view illustrating the configuration of a process cartridge according to a fourth embodiment of the present invention.
Figure 10:
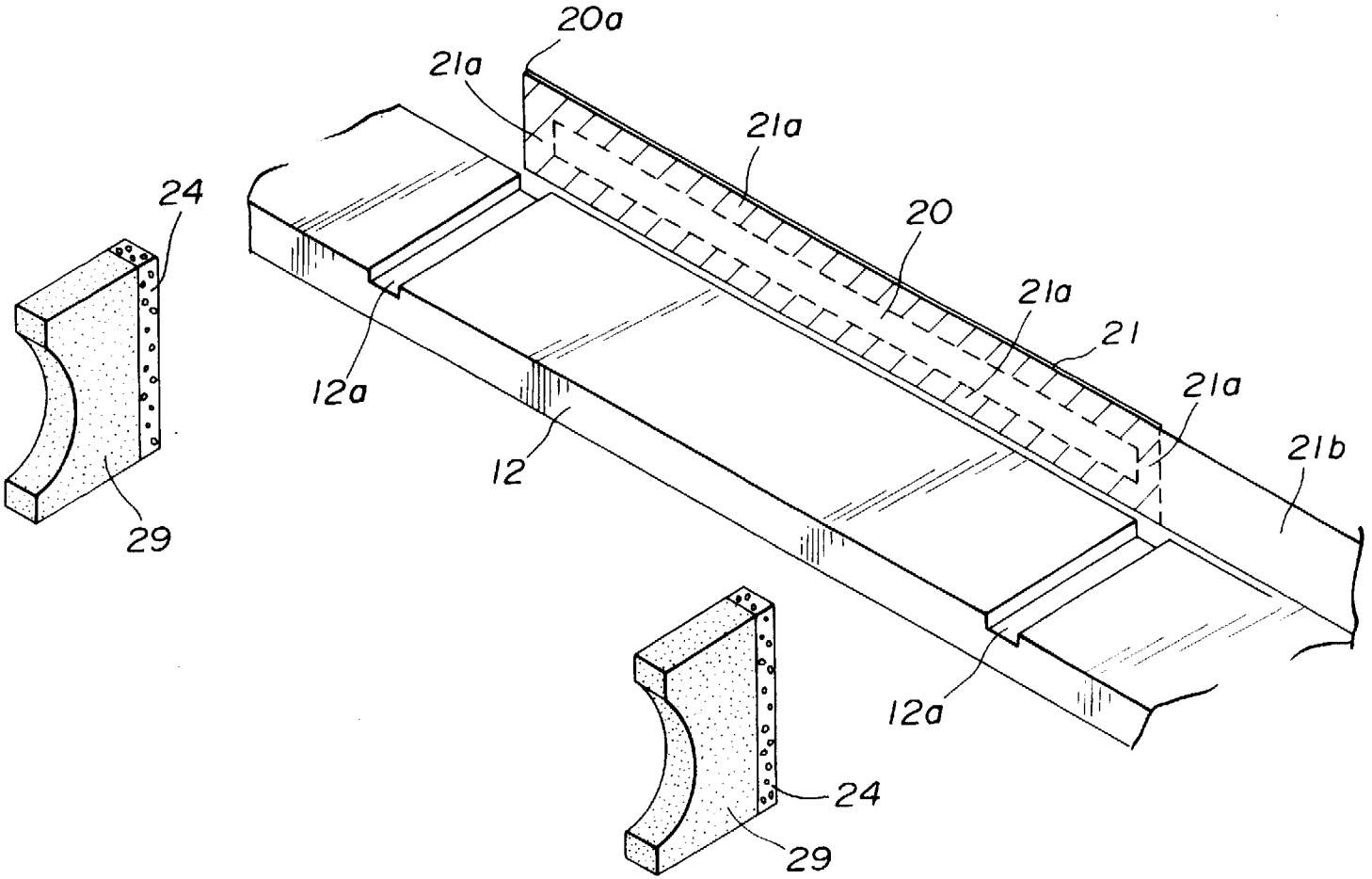
FIG. 10 is a diagram illustrating the configuration of a frame of a developing unit of the fourth embodiment.

Next, a description will be provided of end-portion-seal mounting members according to a fourth embodiment of the present invention, with reference to FIGS. 9 and 10. The basic configuration of a process cartridge and an image forming apparatus on which the process cartridge is removably mountable according to the fourth embodiment is the same as in the first embodiment. Hence, a description will be provided of only a configuration different from the configuration of the first embodiment. Components having the same functions as in the first embodiment are indicated by the same reference characters.

Each of mounting members 29 of the fourth embodiment differs from the seal mounting member 23 of the first embodiment in that the end-portion seal member 22 is omitted by using a magnetic material for the seal mounting member 23.

That is, the mounting member 29 is, for example, made of a magnet, stainless steel, or a plastic material in which ferrite is dispersed, and is mounted along the external circumference of the developing roller 10c with a small gap "a" (see FIG. 9). Since a magnetic force is produced between the magnet 10b within the developing roller 10c and the mounting member 29 in the small gap "a", the toner, made of a magnetic material, remains within the small gap and does not leak to the outside. Hence, it is unnecessary to provide the end-portion seal members 22 as in the foregoing embodiments.

As in the first embodiment, by mounting the mounting members 29 so as to be superposed on the welding portions 20*a* present at both ends of the opening seal member 20 in the longitudinal direction thereof, the same effects as in the first embodiment can be obtained. Since in the fourth embodiment, the end-portion seal members 22 used, for example, in the first embodiment becomes unnecessary, it is possible to reduce the number of components, to improve the assembling capability, and to reduce the production cost.

It is also possible to adopt the configuration of the second embodiment or the third embodiment while configuring the mounting members of a magnetic material. In such a case, the end-portion seal members 22 becomes, of course, unnecessary.

Other Embodiments

Next, a description will be provided of other embodiments with respect to respective components in the above-described embodiments.

The present invention may be suitably applied not only to the above-described process cartridge B for forming a monochrome image, but also to a cartridge, including a plurality of developing means, for forming an image having a plurality of colors (a two-color image, a three-color image, a full-color image, or the like).

Any developing method, such as a known two-component magnetic brush developing method, a cascade developing method, a touch-down developing method, a cloud developing method, or the like, may be used.

The electrophotographic photosensitive member is not limited to the above-described photosensitive drum, but may comprise the following items. That is, a photoconductive material, such as amorphous silicon, amorphous selenium, zinc oxide, titanium oxide, an organic photoconductor (OPC), or the like, is used for the photosensitive member. The photosensitive member may have the shape of a drum, a rotating member, such as a belt or the like, a sheet, or the like. In general, a drum-shaped or belt-shaped photosensitive member is used. A drum-shaped photosensitive member is formed by depositing a photoconductive material on a cylinder, made of aluminum or the like, by means of vacuum deposition, coating, or the like.

In the first embodiment, the charging means has a configuration in which a metallic shield made of aluminum or the like is provided around a tungsten wire, and positive or negative ions produced by applying a high voltage to the tungsten wire are moved to the surface of the photosensitive drum to uniformly charge the surface of the drum. However, a configuration according to a so-called contact charging method using a charging roller may, of course, be adopted.

In addition to the above-described roller-type charging means, for example, (charging) blade-type, pad-type, block-type, rod-type, wire-type charging means may also be used.

As for the method of cleaning toner particles remaining on the photosensitive drum, cleaning means may be configured by a blade, a fur brush, a magnetic brush, or the like.

The above-described process cartridge includes at least developing means. Accordingly, a typical process cartridge may, for example, comprise only developing means, or may comprise developing means, an electrophotographic photosensitive member, charging means, and cleaning means integrated as a catridge so as to be detachably mountable in the main body of the apparatus, or may comprise developing means, an electrophotographic photosensitive member, and charging means or cleaning means integrated as a cartridge so as to be detachably mountable in the main body of the apparatus, or may comprise developing means and an electrophotographic photosensitive member integrated as a cartridge detachably mountable in the main body of the apparatus.

Although in each of the above-described embodiments, a laser-beam printer has been illustrated as the image forming apparatus, the present invention is not limited to the laser-beam printer. For example, an electrophotographic copier, a facsimile apparatus, a word processor, or the like may, of course, be used as the image forming apparatus.

As described above, when sealing the toner supply opening with the opening seal member in the longitudinal direction of the toner bearing member, the mounting members can be mounted in a state of being superposed on the mounting portions of the opening seal member, because the mounting members are provided as members separated from the developing frame.

Accordingly, it is possible to mount the end-portion seal members in the vicinity of the circumference of the toner supply opening, to supply the toner in accordance with the recording width without lengthening the toner bearing member, and to prevent dispersion of the toner at end portions of the developing region. Hence, the length of the developing frame in the longitudinal direction thereof can be shortened, and therefore the size of the process cartridge can be reduced.

By configuring the mounting members with a magnetic material, it is possible to prevent leakage of the toner from a portion between the toner bearing member and the developing frame without providing end-portion seal members, to reduce the number of components, to improve the assembling capability, and to reduce the production cost. Accordingly, in the process cartridge of the present invention, the size can be reduced. In the image forming apparatus for forming an image using the process cartridge, unevenness in the image density is not produced, and a high-quality image can be obtained.

The individual components shown in outline in the drawings are all well known in the process cartridge and electrophotographic image forming apparatus arts and their specific construction and operation are not critical to the operation or the best mode for carrying out the invention.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A process cartridge removably mountable onto a main body of an electrophotographic image forming apparatus, said process cartridge comprising:

an electrophotographic photosensitive member;

a developing device for developing a latent image formed on said electrophotographic photosensitive member;

a developing frame, including a toner receptacle for accommodating toner to be used for development by said developing device, for supporting said developing device;

a toner supply opening, provided in said developing frame, for supplying said developing device with the accommodated toner;

a toner seal, detachably mounted on a mounting portion provided at the circumference of said toner supply opening of said developing frame, for sealing said toner supply opening; and seal members provided in a state of being overlapped with said toner seal at the mounting portion in order to prevent leakage of the toner from said developing frame, wherein said seal members are mounted on corresponding seal mounting members to be mounted on said developing frame, wherein by mounting said seal members at both ends of said developing frame in the longitudinal direction, said seal members are provided in a state of being overlapped with said toner seal at both end portions of the mounting portion in the longitudinal direction thereof, and wherein the mounting portion is provided along the circumference of said toner supply opening, and wherein said seal mounting members are integrated with a lower wall of a developing-means mounting unit, and are disposed at both ends of the wall in the longitudinal direction thereof.

2. A process cartridge according to claim 1, wherein an elastic seal is provided at a side of a lower wall portion facing a surface where said toner supply opening is provided.

3. A process cartridge removably mountable onto a main body of an electrophotographic image forming apparatus, said process cartridge comprising:

an electrophotographic photosensitive member;

a developing device for developing a latent image formed on said electrophotographic photosensitive member;

a developing frame, including a toner receptacle for accommodating toner to be used for development by said developing device, for supporting said developing device;

a toner supply opening, provided in said developing frame, for supplying said developing device with the accommodated toner;

a toner seal, detachably mounted on a mounting portion provided at the circumference of said toner supply opening of said developing frame, for sealing said toner supply opening; and seal members provided in a state of being overlapped with said toner seal at the mounting portion in order to prevent leakage of the toner from said developing frame, wherein said seal members are mounted on corresponding seal mounting members to be mounted on said developing frame, wherein by mounting said seal members at both ends of said developing frame in the longitudinal direction, said seal members are provided in a state of being overlapped with said toner seal at both end portions of the mounting portion in the longitudinal direction thereof, and wherein the mounting portion is provided along the circumference of said toner supply opening, and wherein said seal mounting members are integrated with a developing-blade mounting unit for mounting a developing blade for regulating the amount of the toner adhering to a circumferential surface of a developing roller of said developing device, and are disposed at both ends of the developing-blade mounting unit in the longitudinal direction thereof.

4. A process cartridge according to claim 1 or 3, wherein end seals for preventing leakage of the toner from end portions of said developing device in the longitudinal direction thereof are provided at a side opposite to a side where said seal members are mounted, and wherein said end seals have a circular shape so as to contact the circumferential surface of said developing device.

5. A process cartridge according to claim 4, wherein said seal members comprise an elastic material.

6. A process cartridge according to claim 5, wherein the elastic material comprises one of rubber and sponge.

7. A process cartridge removably mountable onto a main body of an electrophotographic image forming apparatus, said process cartridge comprising:

an electrophotographic photosensitive member;

a developing device for developing a latent image formed on said electrophotographic photosensitive member;

a developing frame, including a toner receptacle for accommodating toner to be used for development by said developing device, for supporting said developing device;

a toner supply opening, provided in said developing frame, for supplying said developing device with the accommodated toner;

a toner seal, detachably mounted on a mounting portion provided at the circumference of said toner supply opening of said developing frame, for sealing said toner supply opening; and seal members provided in a state of being overlapped with said toner seal at the mounting portion in order to prevent leakage of the toner from said developing frame, wherein said seal members are mounted on corresponding seal mounting members to be mounted on said developing frame, wherein by mounting said seal members at both ends of said developing frame in the longitudinal direction, said seal members are provided in a state of being overlapped with said toner seal at both end portions of the mounting portion in the longitudinal direction thereof, and wherein the mounting portion is provided along the circumference of said toner supply opening, and wherein the seal mounting members comprise a magnetic material.

8. A process cartridge according to any one of claims 1, 3 or 7, further comprising a charging member for charging said electrophotographic photosensitive member.

9. A process cartridge according to any one of claims 1, 3 or 7, further comprising a cleaning blade for removing residual toner from said electrophotographic photosensitive member.

10. A process cartridge removably mountable onto a main body of an electrophotographic image forming apparatus, said process cartridge comprising:

an electrophotographic photosensitive drum;

a developing roller for conveying toner to said electrophotographic photosensitive drum by rotating, in order to develop a latent image formed on said electrophotographic photosensitive drum;

a developing frame, including a toner receptacle for accommodating toner to be used for development by said developing roller, for supporting said developing roller;

a toner supply opening, provided in said developing frame, for supplying said developing roller with the accommodated toner;

a toner seal, detachably mounted on a mounting portion provided at the circumference of said toner supply opening of said developing frame, for sealing said toner supply opening;

seal members provided in a state of being overlapped with said toner seal at the mounting portion in order to prevent leakage of the toner from said developing frame, said seal members being mounted on seal mounting members to be mounted on said developing frame, said seal members being provided in a state of being overlapped with said toner seal at both end portions of the mounting portion in the longitudinal direction thereof by mounting said seal mounting members on said developing frame, and said mounting portion being provided along the entire circumference of said toner supply opening;

a charging member for charging said electrophotographic photosensitive drum; and a cleaning blade provided in contact with said electrophotographic photosensitive drum in order to remove toner particles remaining on said electrophotographic photosensitive drum therefrom, wherein said seal mounting members are integrated with a lower wall of a developing-means mounting unit, and are disposed at both ends of the wall in a longitudinal direction thereof.

11. A process cartridge according to claim 10, wherein an elastic seal is provided at a side of a lower wall portion facing a surface where said toner supply opening is provided.

12. A process cartridge removably mountable onto a main body of an electrophotographic image forming apparatus, said process cartridge comprising:

an electrophotographic photosensitive drum;

a developing roller for conveying toner to said electrophotographic photosensitive drum by rotating, in order to develop a latent image formed on said electrophotographic photosensitive drum;

a developing frame, including a toner receptacle for accommodating toner to be used for development by said developing roller, for supporting said developing roller;

a toner supply opening, provided in said developing frame, for supplying said developing roller with the accommodated toner;

a toner seal, detachably mounted on a mounting portion provided at the circumference of said toner supply opening of said developing frame, for sealing said toner supply opening;

seal members provided in a state of being overlapped with said toner seal at the mounting portion in order to prevent leakage of the toner from said developing frame, said seal members being mounted on seal mounting members to be mounted on said developing frame, said seal members being provided in a state of being overlapped with said toner seal at both end portions of the mounting portion in the longitudinal direction thereof by mounting said seal mounting members on said developing frame, and said mounting portion being provided along the entire circumference of said toner supply opening;

a charging member for charging said electrophotographic photosensitive drum; and a cleaning blade provided in contact with said electrophotographic photosensitive drum in order to remove toner particles remaining on said electrophotographic photosensitive drum therefrom, wherein said seal mounting members are integrated with a developing-blade mounting unit for mounting a developing blade for regulating the amount of the toner adhering to a circumferential surface of said developing roller, and are disposed at both ends of the developing-blade mounting unit in the longitudinal direction thereof.

13. A process cartridge according to claim 10 or 12, wherein end seals for preventing leakage of the toner from end portions of said developing roller in the longitudinal direction thereof are provided at a side opposite to a side where said seal members are mounted, and wherein said end seals have a circular shape so as to contact the circumferential surface of said developing roller.

14. A process cartridge removably mountable onto a main body of an electrophotographic image forming apparatus, said process cartridge comprising:

an electrophotographic photosensitive drum;

a developing roller for conveying toner to said electrophotographic photosensitive drum by rotating, in order to develop a latent image formed on said electrophotographic photosensitive drum;

a developing frame, including a toner receptacle for accommodating toner to be used for development by said developing roller, for supporting said developing roller;

a toner supply opening, provided in said developing frame, for supplying said developing roller with the accommodated toner;

a toner seal, detachably mounted on a mounting portion provided at the circumference of said toner supply opening of said developing frame, for sealing said toner supply opening;

seal members provided in a state of being overlapped with said toner seal at the mounting portion in order to prevent leakage of the toner from said developing frame, said seal members being mounted on seal mounting members to be mounted on said developing frame, said seal members being provided in a state of being overlapped with said toner seal at both end portions of the mounting portion in the longitudinal direction thereof by mounting said seal mounting members on said developing frame, and said mounting portion being provided along the entire circumference of said toner supply opening;

a charging member for charging said electrophotographic photosensitive drum; and a cleaning blade provided in contact with said electrophotographic photosensitive drum in order to remove toner particles remaining on said electrophotographic photosensitive drum therefrom, wherein the seal mounting members comprise a magnetic material.

15. An electrophotographic image forming apparatus to which a process cartridge can be mounted to form an image on a recording medium, said apparatus comprising:

(a) mounting means for removably mounting said process cartridge, said process cartridge comprising:

an electrophotographic photosensitive member;

a developing device for developing a latent image formed on said electrophotographic photosensitive member;

a developing frame, including a toner receptacle for accommodating toner to be used for development by said developing device, for supporting said developing device;

a toner supply opening, provided in said developing frame, for supplying said developing device with the accommodated toner;

a toner seal, detachably mounted on a mounting portion provided at the circumference of said toner supply opening of said developing frame, for sealing said toner supply opening; and seal members provided in a state of being overlapped with said toner seal at the mounting portion in order to prevent leakage of the toner from said developing frame, wherein said seal members are mounted on corresponding seal mounting members to be mounted on said developing frame, wherein by mounting said seal members at both ends of said developing frame in the longitudinal direction, said seal members are provided in a state of being overlapped with said toner seal at both end portions of the mounting portion in the longitudinal direction thereof, and wherein the mounting portion is provided along the circumference of said toner supply opening, and wherein said seal mounting members are integrated with a lower wall of a developing-means mounting unit, and are disposed at both ends of the wall in the longitudinal direction thereof; and (b) conveying means for conveying the recording medium.

16. An electrophotographic image forming apparatus to which a process cartridge can be mounted to form an image on a recording medium, said apparatus comprising:

(a) mounting means for removably mounting said process cartridge, said process cartridge comprising:

an electrophotographic photosensitive member;

a developing device for developing a latent image formed on said electrophotographic photosensitive member;

a developing frame, including a toner receptacle for accommodating toner to be used for development by said developing device, for supporting said developing device;

a toner supply opening, provided in said developing frame, for supplying said developing device with the accommodated toner;

a toner seal, detachably mounted on a mounting portion provided at the circumference of said toner supply opening of said developing frame, for sealing said toner supply opening; and seal members provided in a state of being overlapped with said toner seal at the mounting portion in order to prevent leakage of the toner from said developing frame, wherein said seal members are mounted on corresponding seal mounting members to be mounted on said developing frame, wherein by mounting said seal members at both ends of said developing frame in the longitudinal direction, said seal members are provided in a state of being overlapped with said toner seal at both end portions of the mounting portion in the longitudinal direction thereof, and wherein the mounting portion is provided along the circumference of said toner supply opening, and wherein said seal mounting members are integrated with a developing-blade mounting unit for mounting a developing blade for regulating the amount of the toner adhering to a circumferential surface of a developing roller of said developing device, and are disposed at both ends of the developing-blade mounting unit in the longitudinal direction thereof; and (b) conveying means for conveying the recording medium.

17. An electrophotographic image forming apparatus to which a process cartridge can be mounted to form an image on a recording medium, said apparatus comprising:

(a) mounting means for removably mounting said process cartridge, said process cartridge comprising:

an electrophotographic photosensitive member;

a developing device for developing a latent image formed on said electrophotographic photosensitive member;

a developing frame, including a toner receptacle for accommodating toner to be used for development by said developing device, for supporting said developing device;

a toner supply opening, provided in said developing frame, for supplying said developing device with the accommodated toner;

a toner seal, detachably mounted on a mounting portion provided at the circumference of said toner supply opening of said developing frame, for sealing said toner supply opening; and seal members provided in a state of being overlapped with said toner seal at the mounting portion in order to prevent leakage of the toner from said developing frame, wherein said seal members are mounted on corresponding seal mounting members to be mounted on said developing frame, wherein by mounting said seal members at both ends of said developing frame in the longitudinal direction, said seal members are provided in a state of being overlapped with said toner seal at both end portions of the mounting portion in the longitudinal direction thereof, and wherein the mounting portion is provided along the circumference of said toner supply opening, and wherein the seal mounting members comprise a magnetic material; and (b) conveying means for conveying the recording medium.

18. An electrophotographic image forming apparatus to which a process cartridge can be mounted to form an image on a recording medium, said apparatus comprising:

(a) mounting means for removably mounting said process cartridge, said process cartridge comprising:

an electrophotographic photosensitive drum;

a developing roller for conveying toner to said electrophotographic photosensitive drum by rotating, in order to develop a latent image formed on said electrophotographic photosensitive drum;

a developing frame, including a toner receptacle for accommodating toner to be used for development by said developing roller, for supporting said developing roller;

a toner supply opening, provided in said developing frame, for supplying said developing roller with the accommodated toner;

a toner seal, detachably mounted on a mounting portion provided at the circumference of said toner supply opening of said developing frame, for sealing said toner supply opening;

seal members provided in a state of being overlapped with said toner seal at the mounting portion in order to prevent leakage of the toner from said developing frame, said seal members being mounted on seal mounting members to be mounted on said developing frame, said seal members being provided in a state of being overlapped with said toner seal at both end portions of the mounting portion in the longitudinal direction thereof by mounting said seal mounting members on said developing frame, and said mounting portion being provided along the entire circumference of said toner supply opening;

a charging member for charging said electrophotographic photosensitive drum; and a cleaning blade provided in contact with said electrophotographic photosensitive drum in order to remove toner particles remaining on said electrophotographic photosensitive drum therefrom, wherein said seal mounting members are integrated with a lower wall of a developing-means mounting unit, and are disposed at both ends of the wall in a longitudinal direction thereof; and (b) conveying means for conveying the recording medium.

19. An electrophotographic image forming apparatus to which a process cartridge can be mounted to form an image on a recording medium, said apparatus comprising:

(a) mounting means for removably mounting said process cartridge, said process cartridge comprising;

an electrophotographic photosensitive drum;

a developing roller for conveying toner to said electrophotographic photosensitive drum by rotating, in order to develop a latent image formed on said electrophotographic photosensitive drum;

a developing frame, including a toner receptacle for accommodating toner to be used for development by said developing roller, for supporting said developing roller;

a toner supply opening, provided in said developing frame, for supplying said developing roller with the accommodated toner;

a toner seal, detachably mounted on a mounting portion provided at the circumference of said toner supply opening of said developing frame, for sealing said toner supply opening;

seal members provided in a state of being overlapped with said toner seal at the mounting portion in order to prevent leakage of the toner from said developing frame, said seal members being mounted on seal mounting members to be mounted on said developing frame, said seal members being provided in a state of being overlapped with said toner seal at both end portions of the mounting portion in the longitudinal direction thereof by mounting said seal mounting members on said developing frame, and said mounting portion being provided along the entire circumference of said toner supply opening;

a charging member for charging said electrophotographic photosensitive drum; and a cleaning blade provided in contact with said electrophotographic photosensitive drum in order to remove toner particles remaining on said electrophotographic photosensitive drum therefrom, wherein said seal mounting members are integrated with a developing-blade mounting unit for mounting a developing blade for regulating the amount of the toner adhering to a circumferential surface of said developing roller, and are disposed at both ends of the developing-blade mounting unit in the longitudinal direction thereof; and (b) conveying means for conveying the recording medium.

20. An electrophotographic image forming apparatus to which a process cartridge can be mounted to form an image on a recording medium, said apparatus comprising:

(a) mounting means for removably mounting said process cartridge, said process cartridge comprising:

an electrophotographic photosensitive drum;

a developing roller for conveying toner to said electrophotographic photosensitive drum by rotating, in order to develop a latent image formed on said electrophotographic photosensitive drum;

a developing frame, including a toner receptacle for accommodating toner to be used for development by said developing roller, for supporting said developing roller;

a toner supply opening, provided in said developing frame, for supplying said developing roller with the accommodated toner;

a toner seal, detachably mounted on a mounting portion provided at the circumference of said toner supply opening of said developing frame, for sealing said toner supply opening;

seal members provided in a state of being overlapped with said toner seal at the mounting portion in order to prevent leakage of the toner from said developing frame, said seal members being mounted on seal mounting members to be mounted on said developing frame, said seal members being provided in a state of being overlapped with said toner seal at both end portions of the mounting portion in the longitudinal direction thereof by mounting said seal mounting members on said developing frame, and said mounting portion being provided along the entire circumference of said toner supply opening;

a charging member for charging said electrophotographic photosensitive drum; and a cleaning blade provided in contact with said electrophotographic photosensitive drum in order to remove toner particles remaining on said electrophotographic photosensitive drum therefrom, wherein the seal mounting members comprise a magnetic material; and (b) conveying means for conveying the recording medium.

* * * * *

UNITED STATES PATENT AND TRADEMARK OFFICE

CERTIFICATE OF CORRECTION

PATENT NO. : 5,794,101

DATED : August 11, 1998

INVENTOR(S) : KAZUSHI WATANABE ET AL.

It is certified that error appears in the above-identified patent and that said Letters Patent is hereby corrected as shown below:

Title page, item

[57] ABSTRACT

Line 16, "member" should read --members--.

COLUMN 5

Line 30, "receptable" should read --receptacle--.

COLUMN 6

Line 60, "(on" should read --(or--.

COLUMN 17

Line 22, "comprising;" should read --comprising:--.

Signed and Sealed this

Thirteenth Day of April, 1999

*Attest:*

Q. TODD DICKINSON

*Attesting Officer*

*Acting Commissioner of Patents and Trademarks*